United States Patent [19]

Urata et al.

[11] 4,090,177

[45] May 16, 1978

[54] EARLY FIRE COMPOUND SENSING SYSTEM AND APPARATUS

[75] Inventors: Kenrokuro Urata; Yoshiyuki Sasai, both of Tokyo, Japan

[73] Assignee: Yuwa Industrial Co., Ltd., Tokyo, Japan

[21] Appl. No.: 749,713

[22] Filed: Dec. 10, 1976

[30] Foreign Application Priority Data

Dec. 15, 1975 Japan ..... 50-149314

[51] Int. Cl.[2] ..... G08B 17/00

[52] U.S. Cl. ..... 340/227 R; 340/228 R; 340/237 R; 340/237 S

[58] Field of Search ..... 340/227 R, 228 R, 237 R, 340/237 S

[56] References Cited

U.S. PATENT DOCUMENTS 4,027,302 5/1977 Healey et al. ..... 340/227 R

*Primary Examiner*—Glen R. Swann, III

[57] ABSTRACT

An early fire product sensing system and apparatus has at least one earlier fire stage sensor and at least one later fire stage sensor. At least two of such sensors are coupled so that the earlier stage sensor output raises the sensitivity of the later stage sensor. The system is characterized by reducing the fire sensing period without reducing the sensing accuracy.

3 Claims, 2 Drawing Figures

EARLY FIRE COMPOUND SENSING SYSTEM AND APPARATUS

BACKGROUND AND SUMMARY OF THE INVENTION

This invention relates to fire sensing in an earlier stage and yet with minimum error.

As known well, fire expands through following stages:

1. Incipient stage: Incipient and invisible combustion stage and may be said to be not fire but a pre-combustion stage. This stage can be sensed only by a high sensitivity combustion sensor such as an N type semiconductor reducing gas sensor or chemical sensor.

2. Smoldering stage: Combustion stage products are now apparent as smoke. Flame and heat are not yet developed.

3. Flame stage: Flame begins to appear with slight heating effect.

4. Heat stage: High heat is dissipated uncontrollably.

A fire is developed generally through these stages, although the stage duration may differ depending on the respective fire condition. The above respective stages provide their own characteristics and symptoms, and accordingly need different sensors peculiar to the respective stage.

Therefore, if we can detect the stage symptoms separately, we can confirm the fire perfectly by the main symptom as compared with the preceding stage symptom. This is the fundamental idea of this invention for accurately detecting fire in its early stage.

However, simply compounding different symptom sensors such as in "logical AND or OR" can only serve to exclude fire sensing error and has no advantage other than fire sensing error prevention, which can be attained simply by sensing a fire in its developed stage or with a low sensitivity fire sensor. In sensing fire exposing human life to serious danger, there is always another objective; that is, sensing a fire in its earlier stage. The object of this invention is attaining of these two essential objectives, earlier sensing and yet freedom from error.

In this invention, freedom from error is attained by super-imposition of different fire stage sensor outputs and earlier sensing is acomplished in that when an earlier fire stage sensor detects fire, its output is coupled to the subsequent later fire stage sensor so as to raise the latter sensor's sensitivity which is arranged in the latter to be controllable, and accordingly the compounding of different fire stage sensors in this invention attains simultaneously two conditions in fire sensing, "quick and error free".

On the contrary, the conventional prior fire sensor compounding aims principally to exclude sensing error only lacking provision for early sensing.

In addition, the objects of the conventional compounding of different sensors such as available ionization smoke detector and grid resistance compounding are to compensate or cover defects peculiar to individual sensor itself and exclude errors due to these defects. For example, the ionization smoke sensor detects fire by sensing relatively large particles of carbonous substances, but can not sense contaminate, or conductive or wet molecules, while the grid resistance can detect the latter nuisance but can not sense large carbonous particles. Therefore compounding of these two sensors excludes sensing error of fires by sensing concurrence of the above two symptoms that is, the purpose of this type is prevention of error only, unlike this invention.

Further, in general a sensor capable of detecting the weakest symptom or in other words, the earliest symptom of a fire can be said to be most sensitive. In fire sensing, a fire is developed continuously from incipient combustion to ultimate violent disaster and since no definite border can be clearly discriminated physically except that a fire is defined as an uncontrollable combustion and a combustion is not necessarily combined with a fire, earlier fire sensing is always related to fire sensing errors and sensitivity in fire sensing always conflicts with accuracy in sensing.

In this age of utmost respect for human life since a fire exposes many human lives to serious danger, quickness in sensing must be considered more important than errorlessness; in other words, priority must be placed on sensitivity instead of accuracy. Thus the object of this invention is to detect a fire as soon as possible with minimum errors.

Though the above statement is considered to be true, freedom from error also must not be neglected, since annoyance due to too frequent errors makes inevitable the cutting of power to the sensor and leads to disaster and the betrayal of the human relief sought by the fire sensor installation.

This invention also achieves the object of minimizing error by superimposing signals from different fire stage symptoms or final later fire stage sensing preceded by repeated checking of an earlier fire stage sensor as described previously.

DETAILED DESCRIPTION OF THE PREFERRED EMBODIMENTS

Figure 1:
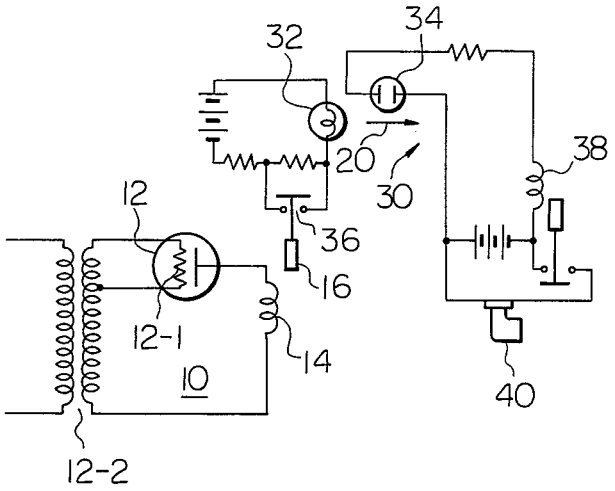
FIG. 1 shows a wiring diagram of an example of the present invention using an N type reducing gas sensor with heating electrode as an earlier fire stage sensor compounded with a photo-electric smoke sensor with sensitivity control means as a later fire stage sensor.

Referring to the attached drawing, in FIG. 1, there is shown a schematic wiring diagram of a compounded fire sensor of this invention combining an N type reducing gas sensor circuit 10 as an earlier fire stage sensor and a photo-electric smoke sensor 30 as a later fire stage sensor.

The N type reducing gas sensor is constituted of a semiconductor reducing gas sensor 12 provided with a heating electrode 12-1 encased in tin oxide or zinc oxide compounds and a relay 14 supplied its controlling power by the transformer 12-2. An armature 16 of said relay 14 is linked to a partial resistance short-circuiting switch 36 of the photo-electric smoke sensor 30.

When the N type semiconductor 12 accepts reducing gases such as carbon monoxide or combustible gas produced due to combustion, it decreases its internal resistance depending on the gas ppm and passes electric current through said relay 14 to close its relay contact 36 and short-circuits part of the resistance in the circuit of a smoke sensor light emitter 32. This smoke sensor is of the light dispersion type whose photo cell is placed at an adjacent side of its light passage 20 from its light emitter 32. Therefore, said cell 34 normally accepts no light and produces no output signal. However, when smoke particles enter in this light passage, they disperse light all around their location and direct partial light towards said photo cell 34. On receiving light, said cell 34 provides an output to close a circuit including an alarm 40. In this type, it is clear from the above description that the larger the light amount from said light emitter 32 becomes, the thinner the smoke content capable of being sensed will be. Thus said earlier fire stage sensor 10 reduces circuit resistance to increase emitter light and raise the sensitivity of said later stage sensor 30.

Figure 2:
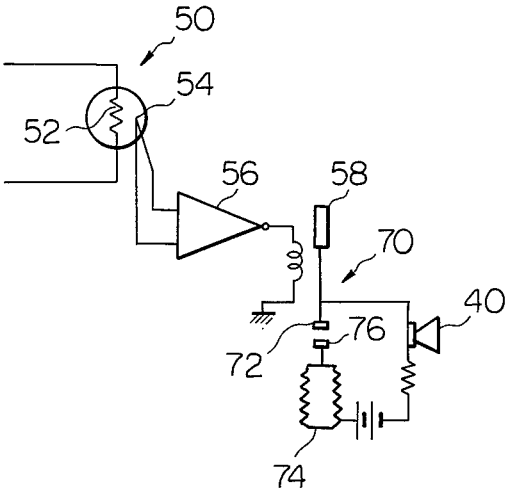
FIG. 2 shows a wiring diagram of an example of the present invention using a catalytic combustion gas sensor as an earlier fire stage senser combined with a heat sensor with a sensitivity control device as a later fire stage sensor.

FIG. 2 is an example of this invention using a catalytic combustible gas detector 50 as an earlier fire stage sensor compounded with heat sensor 70 employing temperature expansion bellows 74 as a later fire stage sensor.

When combustible gas produced by a combustion reaches a catalytic detector 52, said gas is burned by said catalyser and produces heat. This heat is sensed by for example a thermocouple 54 and provides a signal to an operational amplifier 56 to actuate output relay armature 58 to be pulled downwards. On this occasion, a controllable fixed contact 72 linked to said armature 58 approaches said heat expansion bellows 74 contact 76 to facilitate easy closing of contacts 72 and 76. Said heat expansion bellows 74 senses heat produced by a fire and acts as a later fire stage sensor. Acceleration of contact closing by said earlier stage sensor 50 in this manner can be said to raise the sensitivity of a later fire stage sensor and acts to raise the over all sensitivity of said compound sensor without increasing errors.

The above two examples embodying this invention use a semiconductor gas detector or sensor and a catalytic gas sensor as earlier fire stage sensors while a smoke sensor and a heat sensor with sensitivity control means are used as later fire stage sensors. But this invention does not restrict the kinds and numbers of sensors so long as they respond to different fire stages as set forth in the previous fire stage description.

Kinds and modes of coupling between said earlier fire stage sensor and said later fire stage sensor are not restricted also so long as said former stage sensor raises the sensitivity of the later stage sensor whereby over all sensitivity of said compound sensor is elevated.

What is claimed is:

1. A fire sensing system comprising at least one first sensor providing an output responsive to an early fire stage at least one second sensor providing an alarm output responsive to a later fire stage, each such second sensor having a variable sensitivity and a coupling means therebetween enabling the output of any of said first sensors to raise the sensitivities of said second sensor, characterised by elevation of the overall sensitivity of said system with minimum errors.

2. A fire sensing apparatus comprising at least one first sensor providing an output responsive to an early fire stage at least one second sensor providing an alarm output responsive to a later fire stage, each such second sensor having a variable sensitivity and a coupling means therebetween enabling the output of any of said first sensors to raise the sensitivities of said second sensor characterised by elevation of the overall sensitivity of said apparatus with minimum errors.

3. A method for sensing fire comprising the steps of sensing in a first sensor an early fire stage and providing a first output responsive thereto, sensing in a second sensor having an input for controlling the sensitivity thereof a later fire stage and providing a second output responsive thereto for sounding an alarm; and coupling the output of said first sensor to the sensitivity control input of said second sensor for raising the sensitivity of said second sensor upon the sensing of an early fire stage by said first sensor.

* * * * *